US005540196A

United States Patent [19]

Hudock et al.

[11] Patent Number: 5,540,196

[45] Date of Patent: Jul. 30, 1996

[54] MULTI-CYLINDER INTERNAL COMBUSTION ENGINE WITH LOWER CYLINDER COMMUNICATION

[75] Inventors: Daniel S. Hudock, Grosse Pointe; Thomas J. Heater, Milford; Frank V. Crocco, Shelby Township, all of Mich.

[73] Assignee: Ford Motor Company, Dearborn, Mich.

[21] Appl. No.: 542,613

[22] Filed: Oct. 13, 1995

[51] Int. Cl.[6] ..... F02B 33/04

[52] U.S. Cl. ..... 123/73 V

[58] Field of Search ..... 123/73 D, 73 V, 123/735 C, 74 D, 311, 317, 318

[56] References Cited

U.S. PATENT DOCUMENTS

| | | | |
|---|---|---|---|
| 2,118,761 | 5/1938 | Johnson | 123/73 D |
| 2,354,227 | 9/1941 | Szekely | 123/54.7 |
| 2,639,699 | 5/1953 | Kiekhaefer | 123/73 V |
| 2,855,911 | 12/1955 | Christiansen | 123/193.3 |
| 3,815,559 | 6/1974 | Anderson | 123/73 V |
| 4,378,764 | 4/1983 | Jorgensen | 123/307 |
| 4,690,109 | 9/1987 | Ogasahara et al. | 123/73 A |
| 4,834,034 | 5/1989 | Velelcei | 123/73 PP |
| 4,879,974 | 11/1989 | Alvers | 123/73 PP |
| 4,892,066 | 1/1990 | Brown | 123/73 V |
| 5,113,810 | 5/1992 | Ishii | 123/73 R |

FOREIGN PATENT DOCUMENTS

| | | | |
|---|---|---|---|
| 111444 | 7/1928 | Germany | 123/73 V |

*Primary Examiner*—David A. Okonsky
*Attorney, Agent, or Firm*—Neil P. Ferraro

[57] ABSTRACT

A multi-cylinder internal combustion engine cylinder block is formed with communication ports allowing communication between cylinders that, when assembled with pistons and a crankshaft, are 180° out of phase. This allows the trapped mass of air beneath a piston to flow beneath a piston in a different cylinder 180° out of phase. As a result, advancing and returning pistons are matched to effectively balance pressures.

9 Claims, 2 Drawing Sheets

MULTI-CYLINDER INTERNAL COMBUSTION ENGINE WITH LOWER CYLINDER COMMUNICATION

FIELD OF THE INVENTION

The present invention relates to a multi-cylinder internal combustion engine having a port for communication between cylinders, and more particularly, to a multi-cylinder internal combustion engine wherein the communication ports provide ventilation between cylinders having pistons that are 180° out of phase.

BACKGROUND OF THE INVENTION

Typically, internal combustion engines have a trapped mass of air beneath the piston. During each revolution of the crankshaft, this trapped mass of air either compresses or expands, depending upon the stroke of the piston, thereby reducing the efficiency of the engine. To alleviate this problem, prior art arrangements vent the crankcase so as to allow the air to migrate in the crankcase between areas divided by, or demarcated by, the main bearing bulkheads. However, because the vent passages between the bulkheads are somewhat restricted, moving the air mass requires energy. This results in pumping losses which also have a negative effect on engine efficiency. In the present invention, by providing communication ports between cylinders having pistons that are 180° out of phase, a less restricted passage is created, thereby reducing pumping losses.

Accordingly, an advantage of the present invention is to reduce pumping losses by providing communication ports between cylinders having pistons that are 180° out of phase.

Another advantage of the invention is to provide better crankcase breathing which, in turn, allows more efficient oil return from the cylinder head to the oil pan and subsequently increased engine efficiency and fuel economy.

SUMMARY OF THE INVENTION

According to the invention, there is provided a multi-cylinder internal combustion engine having an engine block with a plurality of cylinders and pistons and a crankshaft rotatably attached to said engine block and said pistons, said engine comprising a communication port for allowing communication between two cylinders that are out of phase, said port opening into each said cylinder at an area of low stress thereby allowing a trapped air mass beneath a descending piston to flow into a cylinder beneath an ascending piston.

According to the invention there is also provided a method for reducing pumping loss in an internal combustion engine having an engine block with a plurality of cylinders and pistons and a crankshaft rotatably attached to said engine block and said pistons, said method comprising the steps of identifying cylinders that are out of phase; providing a communication port exclusively between said identified cylinders; and, positioning an opening of said port into said cylinder at an area of low stress such that a trapped air mass beneath a descending piston flows into a cylinder beneath an ascending piston.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 1:
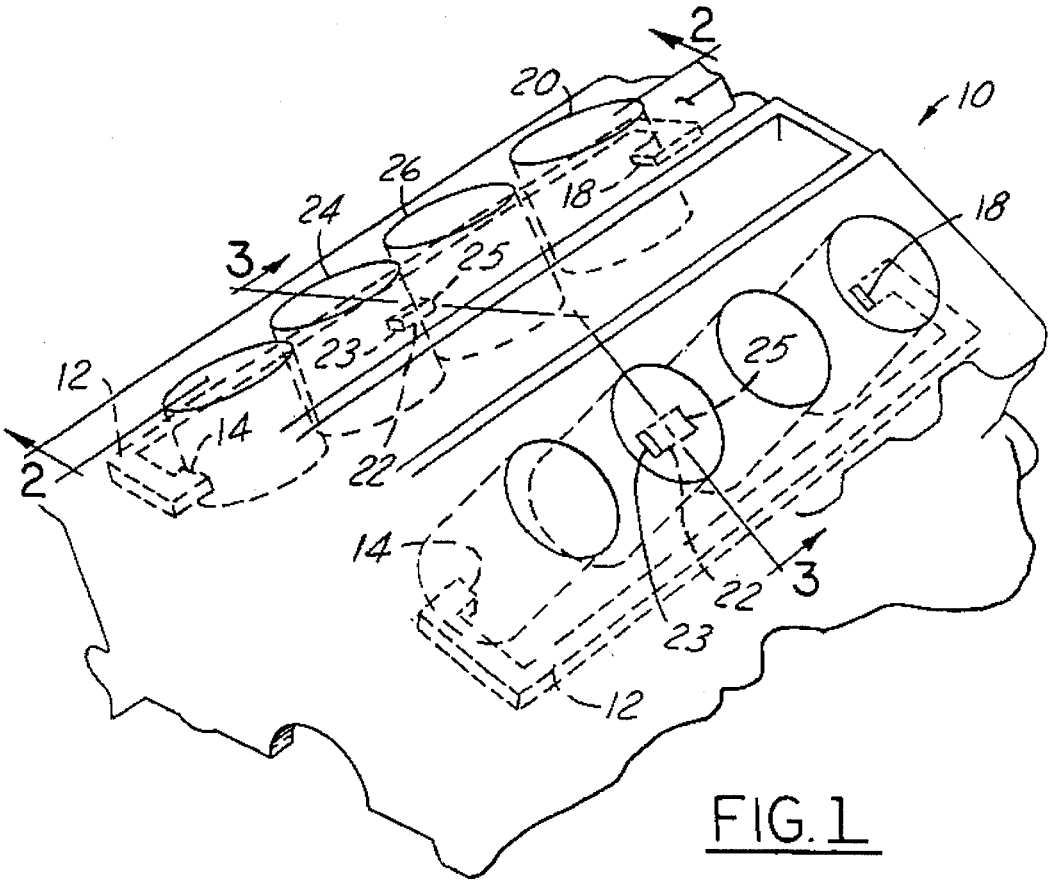
FIG. 1 is a diagrammatic perspective view of an engine block of a multi-cylinder internal combustion engine according to the present invention.

Turning first to FIG. 1, engine block 10 has communication port 12 having an end 14 communicating with cylinder 16 and another end 18 communicating with cylinder 20. Communication port 12 is, for example, formed into engine block 10 when engine block 10 is cast. Of course, as will be apparent to one of ordinary skill in the art in view of the present invention, communication port 12 may t,e formed in engine block 10 using any available manufacturing methods. Indeed, communication port 12 may be formed completely outside engine block 10 by, for example, a tube having ends fixed to cylinders 16 and 20, respectively, and in communication therewith. The purpose of communication port 12 is to reduce pumping loss by connecting cylinders that are 180° out of phase, allowing them to communicate. As used herein, "180° out of phase" means that when one piston in a cylinder is at top dead center ("TDC"), a piston in another cylinder is at bottom dead center ("BDC"). Thus, according to the present invention, it is important to identify the cylinders that would be 180° out of phase prior to manufacturing communication port 12 in engine block 10. In this example, it is shown that cylinder 16 is 180° out of phase from cylinder 20. (See description with reference to FIG. 2.) It should be noted, however, that the two cylinders may be more than or less than 180° out of phase, but anything other than 180° may be less efficient.

Further, an additional communication port, namely, communication port 22, allows communication between cylinders 24 and 26, which are also 180° out of phase. Communication port 22 has ends 23 and 25 which communicate with cylinders 24 and 26, respectively. The purpose of communication ports 12 and 22 is to allow the air in a cylinder beneath a descending piston to flow beneath an ascending piston in another cylinder. This results in a pressure balance between cylinders that are 180° out of phase.

Ends 14, 18, 23 and 25 of ports 12 and 22, respectively, open into their respective cylinders at a location adjacent wrist pin 27 (see FIG. 2) when the piston is at BDC, as shown in cylinder 20. This location is a low stress area in engine block 10 which allows for a stronger bulkhead. In prior art arrangements where crankcase venting occurs between all cylinders, without regard to identifying cylinders. These ports are formed near the end of blind holes used in fastening the main bearing caps, which hold the crankshaft in place, to the engine block. The blind hole is a stress riser that may cause a crack to develop between the end of the blind hole and the end of the port. Thus, placing communication ports 12 and 22 in the location of the prior art ports is undesirable. By locating ends 14, 18, 23 and 25 of communication ports 12 and 22, respectively, within the cylinder below the piston, the probability that a crack will occur is reduced. Thus, this location is considered to be a low stress area. For the sake of clarity, the pistons are not shown in FIG. 1.

Figure 2:
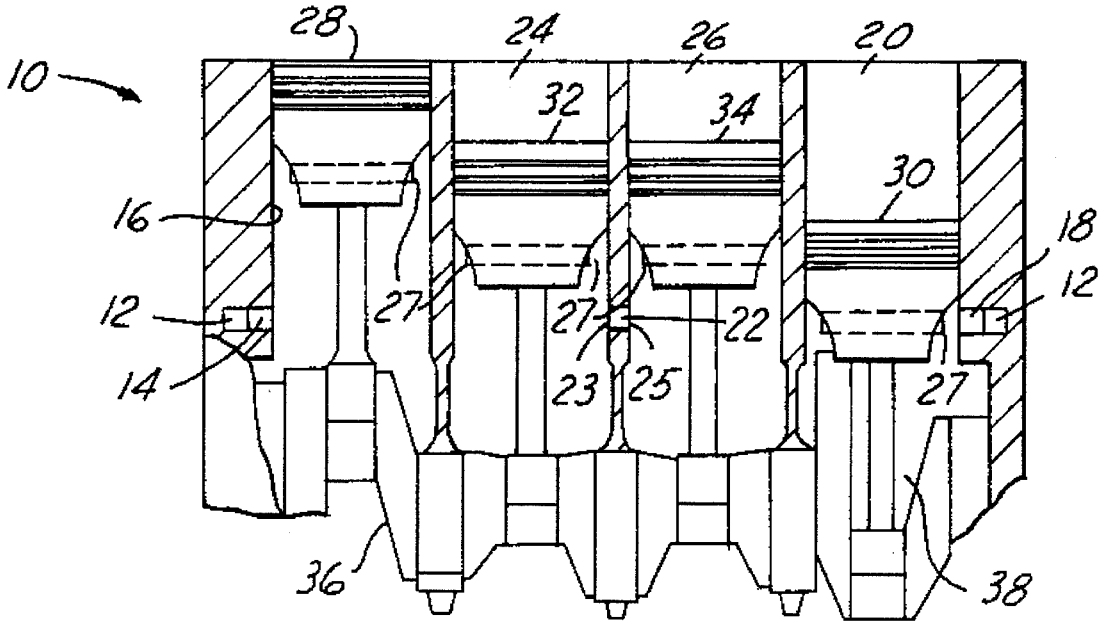
FIG. 2 is a diagrammatic cross-section view of the engine block according to the present invention taken along line 2—2 of FIG. 1.

Referring now to FIG. 2, there is shown a diagrammatic cross-section view of engine block 10 taken along line 2—2 of FIG. 1. Here, it is seen that piston 28 within cylinder 16 is 180° out of phase from piston 30 within cylinder 20. Further, piston 32 within cylinder 24 is 180° out of phase from piston 24 within cylinder 26. As such, when piston 28 is at TDC, piston 30 is at BDC. Pistons 32 and 34 are each shown in mid-stroke but are nevertheless 180° out of phase. As crankshaft 36, located in crankcase 38, rotates, piston 28 moves from TDC toward BDC as viewed in FIG. 2. Thus, the mass of air trapped beneath piston 28 flows into end 14 of communication port 12 and enters cylinder 20 beneath piston 30 through end 18 of communication port 12. Further, as piston 32 moves toward TDC from its mid-stroke position, the trapped mass of air located beneath piston 34 within cylinder 26 enters communication port 22 and then enters cylinder 24. Thus, it can be seen that according to the present invention, the trapped mass of air beneath any piston can flow beneath a piston in another cylinder that is 180° out of phase.

Figure 3:
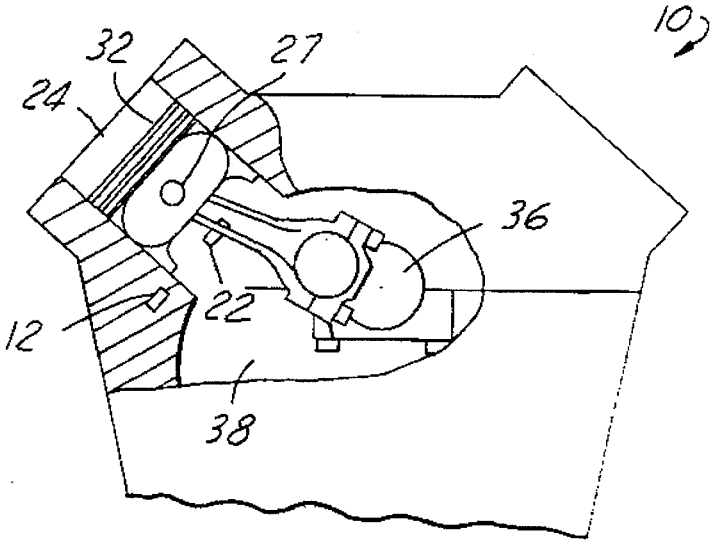
FIG. 3 is a diagrammatic partial cross-section view of the engine block according to the present invention taken along line 3—3 of FIG. 1.

Turning now to FIG. 3, there is shown a diagrammatic partial cross-section view of engine block 10 taken along line 3—3 of FIG. 1. Here, it can be seen that communication port 22 will be adjacent wrist pin 27, when piston 32 moves to BDC, to allow communication with cylinder 26 (not shown). Further, as can be seen in FIG. 3, communication port 12 is formed within engine block 10 to allow communication between cylinders 16 and 20 (not shown).

In the example according to this description, communication ports are shown in a 90° V-8 engine. However, according to the present invention, communication ports in any type of engine, for example a 60° V-8, a V-6, in-line 6 or in-line 4, may be formed within engine block 10 such that there is communication between cylinders which, when assembled with pistons, will be 180° out of phase. Further, as previously discussed, communication ports may be formed completely outside engine block 10.

While the best mode in carrying out the invention has been described in detail, those having ordinary skill in the art to which this invention relates will recognize various alternative designs and embodiments, including those mentioned above, in practicing the invention that has been defined by the following claims.

We claim:

1. A multi-cylinder internal combustion engine having an engine block with a plurality of cylinders and pistons and a crankshaft rotatably attached to said engine block and said pistons, each said cylinder having a cylinder sidewall, said engine comprising:

a communication port for allowing communication exclusively between two cylinders that are out of phase, said port opening into each said cylinder through said cylinder sidewall thereby allowing a trapped air mass beneath a descending piston to flow into a cylinder beneath an ascending piston.

2. An engine according to claim 1 wherein said cylinders are 180° out of phase.

3. An engine according to claim 1 wherein said port opens into each said cylinder at a location adjacent a wrist pin of each said piston when said piston is at bottom dead center.

4. An engine according to claim 1 wherein said port is formed in said engine block.

5. A method for reducing pumping loss in an internal combustion engine having an engine block with plurality of cylinders and pistons and a crankshaft rotatably attached to said engine block and said pistons, each said cylinder having a cylinder sidewall said method comprising the steps of:

identifying cylinders that are out of phase;

providing a communication port exclusively between said identified cylinders; and, positioning an opening of said port into said cylinder through said cylinder sidewall such that a trapped air mass beneath a descending piston flows into a cylinder beneath an ascending piston.

6. A method according to claim 5 wherein said identifying step identifies cylinders are 180° out of phase.

7. A method according to claim 5 wherein said positioning step locates said port opening adjacent a wrist pin of each said piston when said piston is at bottom dead center.

8. A method according to claim 5 further comprising the step of forming said communication port in said engine block.

9. A multi-cylinder internal combustion engine having an engine block with a plurality of cylinders and pistons and a crankshaft rotatably attached to said engine block and said pistons, each said cylinder having a cylinder sidewall, with said engine comprising:

a communication port for allowing communication exclusively between two cylinders that are substantially 180° out of phase, said port opening into each said cylinder through said cylinder sidewall at a location adjacent a wrist pin of each said piston when said piston is at bottom dead center thereby allowing a trapped air mass beneath a descending piston to flow into a cylinder beneath an ascending piston.

* * * * *